US005312032A

United States Patent [19]

Rautenberg et al.

[11] Patent Number: 5,312,032

[45] Date of Patent: May 17, 1994

[54] BAG MACHINE HAVING BURSTING ROLLERS FOR SEPARATING A WEB

[75] Inventors: Horst Rautenberg, Lienen; Rudiger Duwendag, Lengerich, both of Fed. Rep. of Germany

[73] Assignee: Windmoeller & Hoelscher, Lengerich, Fed. Rep. of Germany

[21] Appl. No.: 29,660

[22] Filed: Mar. 10, 1993

[30] Foreign Application Priority Data

Mar. 10, 1992 [DE] Fed. Rep. of Germany .... 4207588.2
Jun. 22, 1992 [DE] Fed. Rep. of Germany .... 4220308.2

[51] Int. Cl.[5] ..... B65H 35/10; B65H 29/06

[52] U.S. Cl. ..... 225/100; 493/362; 156/DIG. 33; 156/DIG. 39

[58] Field of Search ..... 493/210, 214, 239, 344, 493/345, 369, 370, 362; 156/362, 363, 364, 566, 567, 568, DIG. 18, DIG. 33, DIG. 37, DIG. 39, DIG. 45, DIG. 46; 83/102, 107, 115; 225/100

[56] References Cited

U.S. PATENT DOCUMENTS

| | | | |
|---|---|---|---|
| 955,367 | 4/1910 | Spalckhaven | 493/429 |
| 2,499,570 | 3/1950 | Crafts | 83/107 |
| 2,723,604 | 11/1955 | Fischer | 493/345 |
| 3,242,781 | 3/1966 | Risica | 83/107 |
| 3,999,454 | 12/1976 | Tiso | 493/370 |

FOREIGN PATENT DOCUMENTS 6609637 3/1968 Fed. Rep. of Germany .

*Primary Examiner*—Jack Lavinder
*Attorney, Agent, or Firm*—Jacobson, Price, Holman & Stern

[57] ABSTRACT

The invention concerns a bag machine for attachment of strip sections or labels to a passing bag base, including an application drum with a gripper which can be actuated to open and close, and with a knife interacting with the gripper. In this bag machine, the knife is arranged on a second drum running parallel to the application drum. The second drum also features a gripper which interacts with a knife arranged on the application drum.

3 Claims, 1 Drawing Sheet

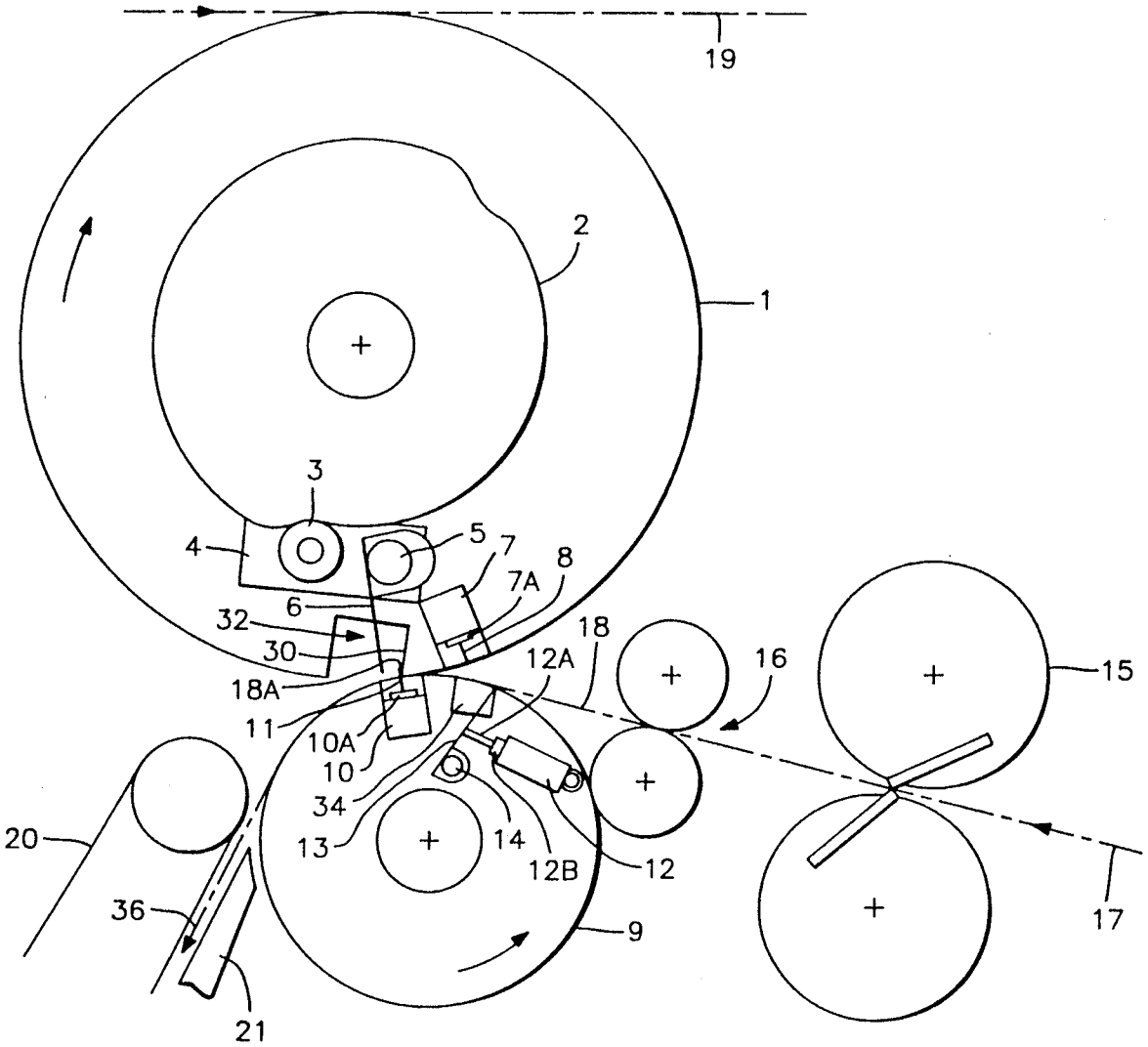
1
2
3
4
5
6
7
7A
8
9
10
10A
11
12
12A
12B
13
14
15
16
17
18
18A
19
20
21
30
32
34
36

BAG MACHINE HAVING BURSTING ROLLERS FOR SEPARATING A WEB

FIELD OF THE INVENTION

The invention concerns a bag machine for the attachment of strip sections or labels to a passing bag base, including an application drum with a gripper which can be actuated to open and close, and with a knife interacting with the gripper.

BACKGROUND OF THE INVENTION

A known bag machine is disclosed in German patent DE 66 09 637 U. In this prior art bag machine, the lack of a bag workpiece results in the associated strip section or label being automatically directed into a removal conveying section. The removal device in this case is controlled by a sensor element which senses on a cyclical basis the feed of a bag workpiece.

Formed on the application drum is a gripper which grips and clamps the forward portion of a label to be attached to the bag base. In this operation, a knife pushes the forward portion of the label into the gripper which then closes and clamps the forward portion of the label. The label is then conveyed by the application drum to be attached to the bag workpiece. If no bag workpiece is fed into position at this time, so that no label need have been conveyed by the application drum, the gripper is opened, and instead the supplied label is taken from underneath by a removal diverter which is slewed into position and which removes the label.

This method of removal has not proven successful in practice as the label to be removed is not positively engaged by the gripper in this area. As a result blockages can occur by loose labels in the area of the removal diverter, resulting in operational malfunctions.

SUMMARY OF THE INVENTION

The object of the invention therefore is to further develop the prior art bag machine such that removal of a strip section or label when required, due to the absence of a bag workpiece, is performed reliably and disruption-free every time.

According to the invention, this object is achieved by a bag machine having a knife arranged on a second drum running parallel to the application drum, and the second drum also featuring a gripper which interacts with a knife arranged on the application drum. Consequently, it is ensured that the strip section or label to be conveyed is always positively engaged and thus is always transferred.

In the case where the label is to be transferred by the application drum to a corresponding passing bag workpiece, the leading edge of the label is engaged by a knife which is arranged on the second drum running parallel to the application drum, and the forward portion of the label is pushed into an open gripper on the application drum. As the transfer operation proceeds, the gripper of the application drum is closed so that the corresponding strip section or label is conveyed to the bag workpiece onto which it is then bonded. If, on the other hand, the strip section or label is to be removed from the application drum, because for example no bag workpiece has been fed into position, the leading edge of the strip section or label is fed by a knife on the application drum into an open gripper on the second drum. This open gripper on the second drum is then closed so that the strip section or label is engaged by the second drum and conveyed away from the application drum. The label can thus be reliably removed from the application drum.

The knives of the application drum and the second drum may be retractable by piston cylinder units into their respective drums.

A conveyor belt and an associated guide plate may be arranged downstream of the second drum to receive and remove the rejected strip section or label being positively conveyed by the second drum.

The drums may be preceded by a perforating unit and a holding roller pair for formation of labels from a continuously fed label web.

Arranged at the application drum may be a fixed can on which a roller runs, the roller being mounted on a lever which can swivel around a pivot point, with a gripper connected to the lever. This facilitates a simple opening and closing control of the gripper on the application drum.

These and other objects of the invention, as well as many of the intended advantages thereof, will become more readily apparent when reference is made to the following description taken in conjunction with the accompanying drawings.

BRIEF DESCRIPTION OF THE DRAWINGS

The figure shows a schematic representation of an embodiment of a strip section application station of a bag machine in a side elevation.

DETAILED DESCRIPTION OF THE PREFERRED EMBODIMENTS

In describing a preferred embodiment of the invention illustrated in the drawing, specific terminology will be resorted to for the sake of clarity. However, the invention is not intended to be limited to the specific terms so selected, and it is to be understood that each specific term includes all technical equivalents which operate in a similar manner to accomplish a similar purpose.

In the figure, a fixed cam 2 is arranged at an application drum 1. A roller 3 runs on this cam, this roller 3 being fixed on a lever 4 which can swivel around a pivot point 5. Also fixed to the lever is a gripper 6 which, through the swivel action of the lever 4, can be closed and opened. The gripper 6 is moved towards and away from a wall 30 of a groove 32 by the movement of the lever 4 caused by displacement of the roller 3. In the depicted embodiment, the gripper 6 is open in a position spaced from wall 30.

Located downstream of the gripper 6, as viewed in the rotational direction, is a piston cylinder unit 7. Fixed to the piston 7A is an insertion knife 8. Arranged below the application drum 1 is a second drum 9 corresponding with the application drum, featuring a piston cylinder unit 10, downstream of which, as viewed in the direction of travel of drum 9, is a further piston cylinder unit 12 by which a gripper 13 can be swivelled around the pivot point 14 by movement of an arm 12A mounted on piston 12B to open or close the gripper 13.

Also shown in the figure is a perforating unit 15 and a holding roller pair 16. In the perforating unit 15, the incoming label web 17 is perforated at predetermined intervals. The downstream holding roller pair 16 then serves to retard the label web 17 so that individual labels can be torn off along the perforation line by drums 1 and 9, the circumferential speed of drums 1 and 9 being greater than the circumferential speed of the holding roller pair 16.

The leading edge 18A of a label 18 is pushed into the groove 32 with open gripper 6 of the application drum 1 by the insertion knife 11 mounted on plunger 10A of the piston cylinder unit 10, by actuation of the piston cylinder unit 10, with the gripper 6 interacting with a wall 30 of the drum 1 to hold the leading edge 18A of the label 18 in position. As the application drum 1 continues to rotate, the lever 4 is swivelled in the direction of wall 30 to close the gripper 6 so that the label 18 is held firmly by the gripper 6 on the application drum 1. Following further rotation of the application drum 1 around approximately 180 degrees, the label 18 is then bonded to a bag base which travels along the bag passage 19.

If, during operation of the application drum 1, it becomes apparent that there is no bag travelling through the bag passage 19, the label 18 torn from the label web 17 must be removed. In order to achieve this, it is necessary to retract knife 11 by retraction of piston 10A of piston cylinder unit 10 and extend knife 8 mounted on piston 7A of the piston cylinder unit 7. Through the action of the extended knife 8, the label 18 is moved into groove 34 of second drum 9 where the label is gripped by the gripper 13 by actuation of piston cylinder unit 12, with gripper 13 interacting with a fixed edge of drum 9. As the drum 9 continues to rotate, the label 8 thus held in drum 9 is carried in a counterclockwise direction and then transferred to a conveyor belt 20 and an associated guide plate 21 in the direction of arrow 36 upon release from gripper 13. This ensures that an unwanted label 18 is positively removed from the area of the application drum 1, thus eliminating the probability of blockages occurring in the operation of the application drum 1.

Having described the invention, many modifications thereto will become apparent to those skilled in the art to which it pertains without deviation from the spirit of the invention as defined by the scope of the appended claims.

We claim:

1. An apparatus for attaching strip sections or labels to a passing bag base, said apparatus comprising:

an application drum, a gripper of said application drum actuatable to open and close, a second drum running parallel to the application drum, an insertion knife of said second drum interacting with said gripper of said application drum for inserting a leading end of a strip section or label into said gripper of said application drum, a gripper of said second drum, and an insertion knife of said application drum interacting with said gripper of said second drum for inserting the leading end of a strip section or label into said gripper of said second drum, said insertion knife of said application drum and said insertion knife of said second drum being retractable into said application drum and said second drum, respectively, by separate piston cylinder units, said application drum and said second drum being preceded by a perforating unit for perforating a label web and a holding roller pair for holding the label web so that the label web is torn off from the holding roller pair by the application drum and the second drum rotating at a higher speed of rotation than said holding roller pair.

2. An apparatus according to claim 1, wherein a conveyor belt and an associated guide plate are arranged downstream of said second drum.

3. An apparatus according to claim 1, wherein a fixed cam is arranged on said application drum and a roller runs on said cam, said roller is mounted on a lever swivellable around a pivot point, and said gripper of said application drum is connected to said lever for actuation of said gripper of said application drum to open and close upon displacement of said roller.

* * * * *